US009580903B2

(12) United States Patent
Altay

(10) Patent No.: US 9,580,903 B2
(45) Date of Patent: Feb. 28, 2017

(54) LIQUID COLUMN DAMPING SYSTEM

(71) Applicant: Rheinisch-Westfaelische-Technische Hochschule Aachen, Aachen (DE)

(72) Inventor: Okyay Altay, Aachen (DE)

(73) Assignee: RHEINISCH-WESTFAELISCHE-TECHNISCHE HOCHSCHULE AACHEN, Aachen (DE)

( * ) Notice: Subject to any disclaimer, the term of this patent is extended or adjusted under 35 U.S.C. 154(b) by 0 days.

(21) Appl. No.: 14/897,899

(22) PCT Filed: Apr. 9, 2014

(86) PCT No.: PCT/EP2014/000944
§ 371 (c)(1),
(2) Date: Dec. 20, 2015

(87) PCT Pub. No.: WO2014/206507
PCT Pub. Date: Dec. 31, 2014

(65) Prior Publication Data

US 2016/0130804 A1 May 12, 2016

(30) Foreign Application Priority Data

Jun. 26, 2013 (DE) ..... 10 2013 010 595

(51) Int. Cl.

| | |
|---|---|
| ***E04B 1/98*** | (2006.01) |
| ***E04H 9/02*** | (2006.01) |
| ***B63B 39/03*** | (2006.01) |

(52) U.S. Cl.
CPC ..... *E04B 1/985* (2013.01); *B63B 39/03* (2013.01); *E04H 9/02* (2013.01); *E04H 2009/026* (2013.01)

(58) Field of Classification Search
CPC ..... E04B 1/985; E04H 9/02; E04H 2009/026; B63B 39/03
See application file for complete search history.

(56) References Cited

U.S. PATENT DOCUMENTS 970,368 A 9/1910 Frahm
5,070,663 A 12/1991 Sakai
(Continued)

FOREIGN PATENT DOCUMENTS

EP 0362125 A1 * 4/1990 ..... B03B 9/04
JP 04258545 A * 9/1992
(Continued)

*Primary Examiner* — Jeanette E Chapman
(74) *Attorney, Agent, or Firm* — Andrew Wilford

(57) ABSTRACT

The invention relates to a liquid column damping system, particularly for damping building vibrations, comprising a tank (B, S1, S2) filled with a liquid, said tank having, in particular, a substantially U-shaped geometry in at least one direction. At least two columns (S1, S2) of the tank arranged at a distance from each other, particularly for forming communicating liquid columns, are connected by a base region (B) of the tank, and means for adjusting the damping of the liquid column damping system and/or the natural frequency of the liquid column damping system are provided. At least one column wall region (W1) in at least one of the columns (S1, S2), preferably in all columns, can be moved in order to change the column cross-section.

10 Claims, 4 Drawing Sheets

(56) References Cited

U.S. PATENT DOCUMENTS

| | | | | | |
|---|---|---|---|---|---|
| 5,255,764 | A * | 10/1993 | Kurabayashi | F16F 7/1017 | 188/380 |
| 5,542,220 | A * | 8/1996 | Yoshimura | E04B 1/985 | 188/378 |
| 8,429,862 | B2 * | 4/2013 | Yin | E04B 1/985 | 248/636 |
| 2004/0201153 | A1 * | 10/2004 | Chen | B60G 13/16 | 267/140.15 |
| 2010/0200348 | A1 * | 8/2010 | Reiterer | F16F 7/1034 | 188/378 |

FOREIGN PATENT DOCUMENTS

| | | | | |
|---|---|---|---|---|
| JP | 06094072 | A | * | 4/1994 |
| JP | 09151986 | A | * | 6/1997 |
| JP | 10046868 | A | * | 2/1998 |
| JP | 2000081080 | A | * | 3/2000 |
| JP | 2000120771 | A | * | 4/2000 |
| KR | 20150060309 | A | * | 6/2015 |

* cited by examiner

LIQUID COLUMN DAMPING SYSTEM

CROSS REFERENCE TO RELATED APPLICATIONS

This application is the US-national stage of PCT application PCT/EP2014/000944 filed 9 Apr. 2014 and claiming the priority of German patent application 102013010595.1 itself filed 26 Jun. 2013.

FIELD OF THE INVENTION

The invention relates to a liquid-column damping system, in particular a semiactive liquid-column damping system that can be used for example for damping vibrations in buildings or other objects, comprising a substantially U-shaped tank filled with a liquid and having, seen in at least one direction, at least two columns spaced from each other and connected by a base region, such that in particular communicating liquid columns are formed and means is provided for adjusting the damping and/or the natural frequency thereof.

BACKGROUND OF THE INVENTION

Passive liquid-column damping systems are known from the prior art, for example from U.S. Pat. No. 970,368, and are based on the operating principle that during vibrations in the liquid present in the liquid-column damping system, for instance a Newtonian fluid, the liquid column is moved and energy is dissipated by the effects of turbulence and the local pressure losses due to friction that form in the liquid columns or in the base region of the tank during vibration.

The basic principle of such a liquid-column damping system is also referred to as a Frahm antiroll tank, in recognition of the technology that can be traced back to the inventor Frahm. Such a tank operating according to this principle also forms the subject of the present invention.

Further embodiments of such a system are known from the prior art that comprise means for adjusting the damping and/or the natural frequency of such a liquid-column damping system. Such means comprise, for example, openings in the base region of the tank that limit flow between the two columns through the base region of the tank more or less, according to the degree of opening, means for adjusting the liquid level in the columns, means for adjusting the spacing between the columns of such a tank as well as optional means for forming a pressurized air cushion above the columns, meaning above the liquid level.

These measures known in the prior art have proven to be structurally complex and prone to errors, so that an object of the present invention is to provide means for adjusting the damping and/or the natural frequency of such a liquid-column damping system that function reliably and that can be realized on such a liquid-column damping system in a structurally favorable manner.

OBJECT OF THE INVENTION

This object is achieved according to the invention in that, in at least one of the columns, preferably all, of such a liquid-column damping system, at least one column wall can be moved in order to change the column cross-section.

SUMMARY OF THE INVENTION

Through such a modification of the column cross-section of at least one, preferably all, columns, the natural frequency of the liquid mass of the liquid used in the liquid-column damping system, for example a Newtonian fluid (such as a mixture of water and antifreeze), may preferably be achieved in such a liquid-column damping system.

Here, according to an embodiment of the invention a change of the column cross-section in one, preferably all, columns can be undertaken only in a direction perpendicular to a flow direction between the two columns, while a flow cross-section in the flow direction remains unaffected by the device according to the invention.

According to a preferred embodiment, in a column with such a movable column wall, at least one column wall, preferably two mutually opposite column walls, in particular above the base region of the tank, are formed in a double-walled manner for the formation of the movable column wall, and the double wall has an inner wall panel and an outer wall panel and the inner wall panel can be displaced relative to the outer wall panel, meaning into the volume of the column.

According to the invention, the outer shape of a liquid-column damping system is defined by the rigid outer wall, however the inner shape is changed by displacement of at least one, preferably two opposite inner wall panels, in particularly the optional reduction of the spacing between these inner wall panels.

In order to prevent back-flow, in particular of an inner wall panel spaced apart from an outer wall panel after such a displacement, the respective inner wall panel can be connected at its lower end with the respective outer wall panel.

Such a connection seals the region between the outer wall panel and inner wall panel in the direction of flow of the liquid mass such that a liquid mass displaced between the columns during vibration is guided out of the base region of the tank from against the inner wall from the outer wall panel past an element connecting the inner wall panel with the outer wall panel, so that the liquid mass flows into a reduced flow cross-section during its movement.

According to a preferred embodiment of the liquid-column damping system of the invention, one column, in particular each column, has the above-described double-walled construction on two mutually opposite walls, thus a column has a respective inner wall panel on each of the two mutually opposite walls and the inner wall panels can be displaced inward against the respective outer wall panel.

Here, the opposite walls may here preferably be such a column wall, the normal of which extends perpendicular to the flow direction between the at least two columns, and further preferably a respective column wall, the normal of which lies with at least one component in the flow direction of the at least two columns, is fixed.

The above-mentioned embodiment is hereby achieved according to the invention, in which a change in cross-section takes place within a column of an inventive, in particular U-shaped, tank in a direction perpendicular to the flow direction between the columns, while the cross-section in the flow direction of the columns remains unaffected.

According to a possible embodiment of the liquid-column damping system, a movable column wall has an inner wall panel that is formed by at least one plate mounted on the outer wall panel in a movable, preferably rotatable, in particular pivoted manner. With such a movable mounting of the plate, in particular at its lower end with the associated outer wall, the plate is, for example, shifted or tilted parallel with respect to an outer wall, for example inclined inward, and on the one hand the flow cross-section is reduced, and on the other hand back-flow of the inner wall panel is avoided and the stream of liquid is guided by the connection between the plate and outer wall at the lower region of the plate.

Such a movable connection may be realized, for example, in that a plate formed as an inner wall panel is fixed to the outer wall at its lower edge by, for example, an elastomeric plate or a surface made from a thin, flexible sheet.

Alternatively, a plate that forms the inner wall panel may also be pivoted on the outer wall, and thus for example may be tilted inward from its flush position (substantially parallel to the outer wall), after which this plate serving as an outer wall extends at an acute angle to the outer wall.

As in the case of such a possible tilting of a plate serving as the inner wall, the cross-section of a column is not constant with respect to height, according to a preferred embodiment an inner wall panel is displaced by parallel shifting relative the outer wall at each location of its possible position, and has here a connection in its lower region to the outer wall. Here, too, in one of many possible embodiments the connection at the lower region of the inner wall is again formed by a flexible plate or flat element that in particular merges the planes of the outer wall and inner wall to one another.

According to a preferred embodiment, a movable column wall has an inner wall panel movable toward the outer wall panel that inner wall panel is formed from at least two relatively movable plates that are in particular pivoted on each other and that, for example, have respectively parallel pivot axes from which the lowest plate is mounted to the outer wall panel in a movable, in particular again pivoted, manner.

Here, it is possible to move at least the uppermost plate of this arrangement of a plurality of plates that form the inner wall panel parallel to the outer wall, in particular from a near position parallel to the outer wall, in particular a contacting position, preferably into a plurality of positions of different spacings from the outer wall.

Here, the parallel displacement of the at least one upper plate may cause that the lowest plate that forms the connection to the outer wall panel, moves from a vertical direction through different angular positions according to the spacing between the inner wall panel and outer wall panel.

Thus, it may therefore be provided that in a location of the upper, in particular the uppermost, plate of the inner wall in the position closest to the outer wall, in particular a contacting position, a lower plate is similarly oriented substantially parallel to the outer wall or, at most, with a small angle of less than 5° to the outer wall, while the maximum spacing of the upper, in particular the uppermost, plate is achieved when the lowermost plate is oriented perpendicular to the outer wall, thus the parallel distance between inner wall and outer wall results from the length of this connecting lowermost plate, in particular if the inner wall panel is formed from just two plates.

All intermediate locations, meaning the different spacings between the upper plate and the outer wall, result accordingly from angles between the lower plate and the outer wall between 0° and 90°.

It is thereby further achieved that, during vibration of the liquid mass within the damping system according to the invention, the moving liquid always flows on an inclined lower plate of the inner wall panel while flowing out of the lower base region into a column, except at the maximum displacement, in which this lowermost plate is oriented perpendicular to the liquid stream.

An inventive liquid-column damping system may provide according to a further development that the position of a movable inner wall panel, in particular at least the position of an upper or uppermost plate of such an inner wall panel, and preferably the parallel distance to the outer wall panel, is adjustable relative to the outer wall panel by at least one drive.

Here, a plurality of drive variants are possible, and one variant may provide that only a single drive is provided in the inventive liquid-column damping system with which the position of all inner wall panels of all columns can be adjusted simultaneously. This has the effect that the cross-section of the two opposite columns, which are interconnected through the base region of the tank, are set simultaneously and preferably to the same cross-sectional value.

According to another embodiment each column has its own drive, with which mutually opposite inner wall panels of the respective column can be adjusted simultaneously. This has the effect that, although the opposite inner wall panels are set at the same time and preferably to the same spacing to their respective outer walls, in principle the cross-sections of the two mutually opposing columns connected through the base region can nevertheless be adjusted differently.

According to another embodiment each inner wall panel has its own drive, with which the position of this inner wall panel can be adjusted relative to the respective outer wall panel.

In all embodiments, an inner wall panel that can be adjusted in spacing relative to a respective outer wall panel need not necessarily extend over the entire width of the associated outer wall panel, although this is preferable according to the invention.

In one possible embodiment of an inner wall substantially over the entire width of the associated outer wall, it can abut sealingly to the wall portion of a column oriented perpendicular to the outer wall, although this is not absolutely necessary for the proper functioning of a liquid damper, and in one embodiment variant is even to be expressly avoided, in order to allow a backfilling with liquid of the region between the inner wall and outer wall to thus accommodate displacement of the inner wall relative to the outer wall with as little resistance as possible. This embodiment may therefore provide that the inner wall, which is movable relative to an outer wall, is completely surrounded by liquid within the liquid-column damping system.

A possible embodiment may also provide that, with respect to the width of an outer wall, the inner wall is subdivided, in particular divided at least in two, so that a first inner wall is adjustable in its spacing from the common outer wall independent of a second inner wall.

Here, each individually adjustable inner wall may have the construction previously described with respect to an inner wall, thus in particular a construction from one or more plates that are movable with respect to one another, in particular pivoted to each other, and that have a movable, in particular pivoted, connection in their lower region to the outer wall.

Particularly in the undivided embodiment of an inner wall over its width, the movable inner wall panel, here in particular in the case of an inner wall panel may be formed by a plurality of plates, the uppermost plate being guided with its side regions on two opposite immobile surfaces of the respective column. Through such guiding, a drive for adjusting the position of an inner wall with respect to an outer wall need not function to hold the inner wall, but rather need only assume an adjusting function, as the holding function can be reproduced via the guiding.

A liquid-column damping system according to the invention may further be provided with at least two vibration sensors that are provided, for example, at the upper and lower regions of an object to be damped, for example a building; in addition to these vibration sensors that may be formed as motion sensors, level sensors for the liquid level and/or wind sensors may be used, as well as a controller that is designed to calculate the necessary natural frequency and/or necessary natural damping of the liquid-column damping system from the measured values of the at least two vibration sensors and optionally the additional sensors, and to adjust the liquid-column damping system by adjustment of the cross-section of the columns, in particular by adjustment of the inner wall.

Thus, for example, differences in stiffness between summer and winter in an object to be damped, such as a building, can be taken into account and the resulting changes in the required natural damping or the natural frequency taken into account in a liquid damping system according to the invention.

In addition to conventional buildings, such a liquid damping system according to the invention may also be used for the damping of other vibrating objects, such as wind turbines or other in particular tower-like structures.

In addition to the above-described inventive device for adjusting the column diameter, a liquid-column damping system according to the invention may further ensure that in the base region of the tank, i.e. that region that allows flow between the two columns, at least one opening is provided that is adjustable in cross-section. This opening may be used to adjust the cross-section of this connecting region in the flow direction between the columns to differing sizes and thus change the flow resistance in the flow of the liquid mass between the columns.

Moreover, the possibility also exists of connecting a reservoir with liquid to the liquid-column damping system according to the invention and thus to change the level of liquid in the liquid-column damping system according to the invention, in that liquid can be pumped from the reservoir into the damping system or out of the damping system into the reservoir. In particular, the liquid mass and thus especially the natural frequency of the liquid-column damping system according to the invention can be influenced.

BRIEF DESCRIPTION OF THE DRAWING

An illustrated embodiment of the invention is shown in perspective in FIG. 1, in two side sectional views in FIGS. 2A and 2B, and in top and end views in FIGS. 3 and 4.

SPECIFIC DESCRIPTION OF THE INVENTION

The figures show a liquid-column damping system comprising a substantially U-shaped tank seen in at least one direction, this tank comprising two columns $S_1$ and $S_2$ that are spaced from one another by a connecting base region B. The columns project upward from the base region and are vertical here, although this is not mandatory.

In a position of equilibrium shown dotted in FIG. 2, the two columns $S_1$ and $S_2$ have the same liquid level L, due to the principle of communicating vessels. If vibrations arise on objects comprising such a damping system, the vibrations are also transferred to the damping system and generate a displacement of the liquid within the damper, that is, from one column to another, resulting in a flow between the liquid columns through the base region B.

The natural frequency and natural damping of such a system may now be fundamentally influenced for optimum effectiveness through the active liquid volume and the flow resistances that oppose the liquid during movement. In particular FIG. 2B and the perspective view of FIG. 1 make clear that the two columns $S_1$ and $S_2$, which preferably have rectangular cross-sections, respectively have walls $W_1$ and $W_2$, and the normal (in the Z-direction) to one wall $W_1$ is perpendicular to a flow direction (in the X-direction) in the base part B, meaning that the flow direction of the liquid connection extends between the two columns $S_1$ and $S_2$ and the one wall $W_2$ extends parallel to this flow direction.

Figures 2A, 2B:
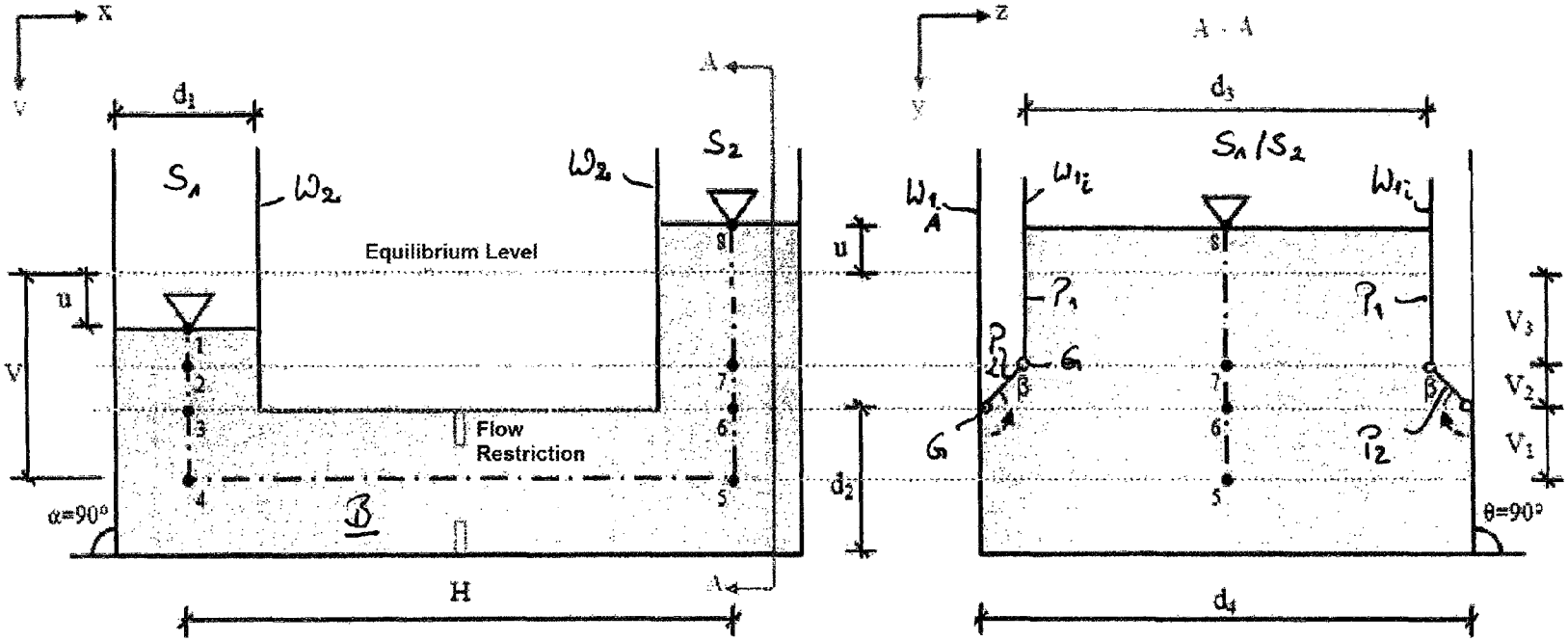

With particular reference to FIGS. 2A and 2B, according to the invention the column wall $W_1$ with a normal perpendicular to the flow direction x between the columns $S_1$ and $S_2$ is formed in a double-walled manner with an inner wall $W_{1i}$ and an outer wall $W_{1a}$, and a spacing of the inner wall $W_{1i}$ to the outer wall $W_{1a}$ can be varied.

With reference to FIGS. 2A and 2B, the embodiment is here such that the inner wall $W_{1i}$ is formed from two individual plates $P_1$ and $P_2$ that are connected with one another via pivots G, and further the lower plate $P_2$ has a similar pivot connection G to the outer wall $W_{1a}$. For example, an inner wall $W_{1i}$ may accordingly be set parallel to the outer wall $W_{1a}$ at different spacings, for instance by an actuator, and the plate $P_2$ assumes different angles of inclination $\beta$ to the outer wall $W_{1a}$ depending on the spacing.

The spacing between the two opposite inner walls $W_{1i}$ can be reduced, while the spacing between the walls $W_2$ oriented perpendicular thereto remains constant. According to the embodiment shown the plates $P_1$ and $P_2$ that form the inner walls $W_{1i}$ optionally have the same width up to a remaining gap region, as the respective outer walls $W_{1a}$. The plates $P_1$ and $P_2$ may each also sealingly abut the walls $W_2$.

The possibility thus exists, in particular in dependence on the measured sensor values, to alter the cross-section of one of each of the columns $S_1$ and $S_2$, and preferably according to the invention the cross-section in both mutually spaced columns is adjusted simultaneously and to the same extent.

In particular FIGS. 2A and 2B show that the system according to the invention also has the advantage of a particularly simple design since the outer shape of a liquid column according to the invention may remain unchanged, as here, for example, the outer walls $W_{1a}$ and $W_2$ are rigid. In contrast, only the inner walls $W_{1i}$ can be displaced.

Instead of an embodiment of an inner wall $W_{1i}$ formed by the two exemplary plates $P_1$ and $P_2$ that are pivotally interconnected, only one rigid plate $P_1$ is used that may be displaced parallel to an outer wall $W_{1a}$, and, in the place of the plate $P_2$, the lower region of such a plate $P_1$ is connected with the rigid outer wall $W_{1a}$ by a flexible element such as a thin sheet or a flat/plate-shaped elastic element. This results in a movable, semipivoted connection through the flexibility of this flexible connecting element.

Figure 1:
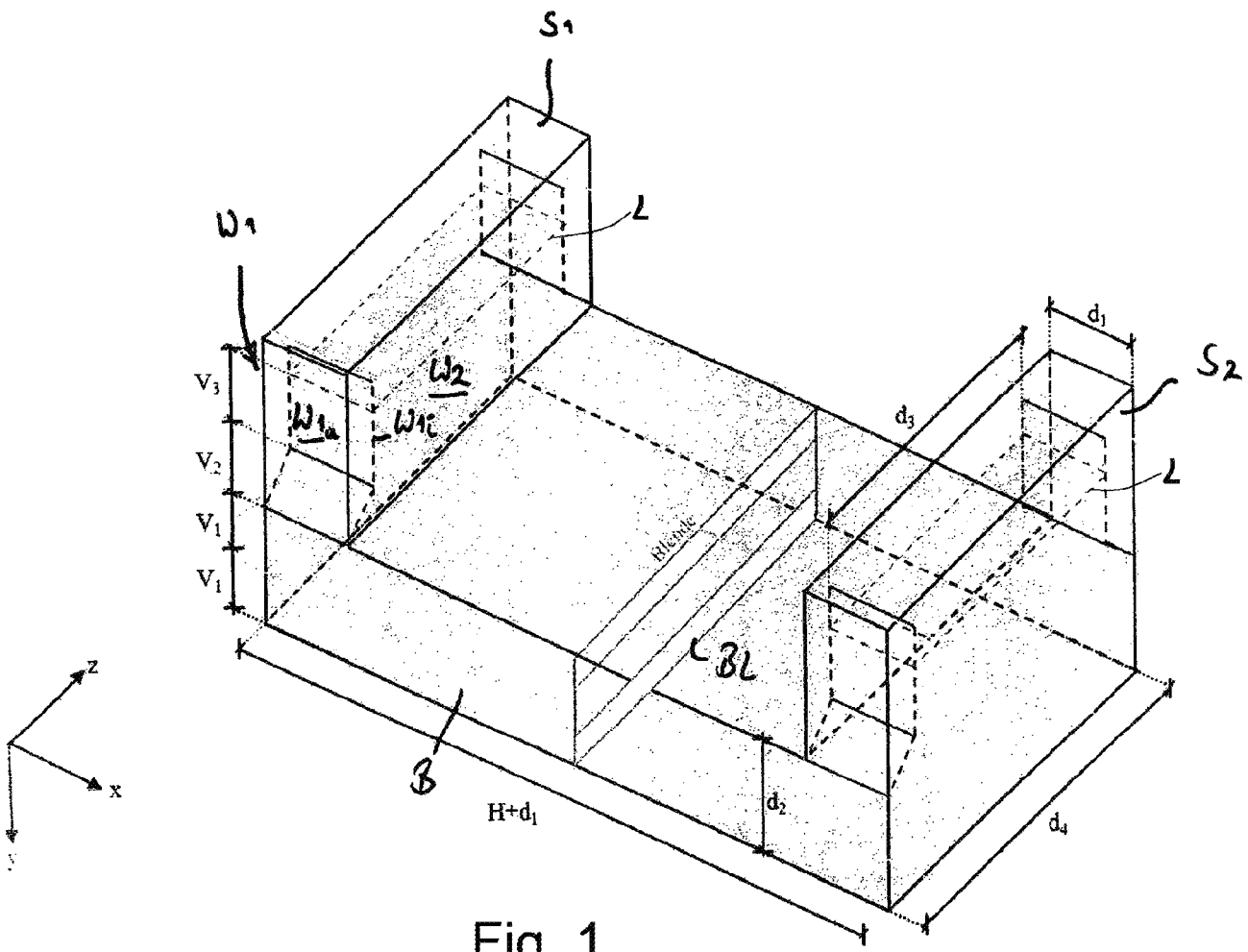

In addition to the embodiment according to the invention, FIG. 1 shows that the lower base region B that connects the columns $S_1$ and $S_2$ also has an additional opening BL extending over its total height and width, the opening cross-section of which can be changed, in particular in the vertical direction, for example by a controllable actuator. Moreover, here, although not shown, the liquid content, i.e. the volume of the liquid mass moved, may also be adjusted.

Figure 3:
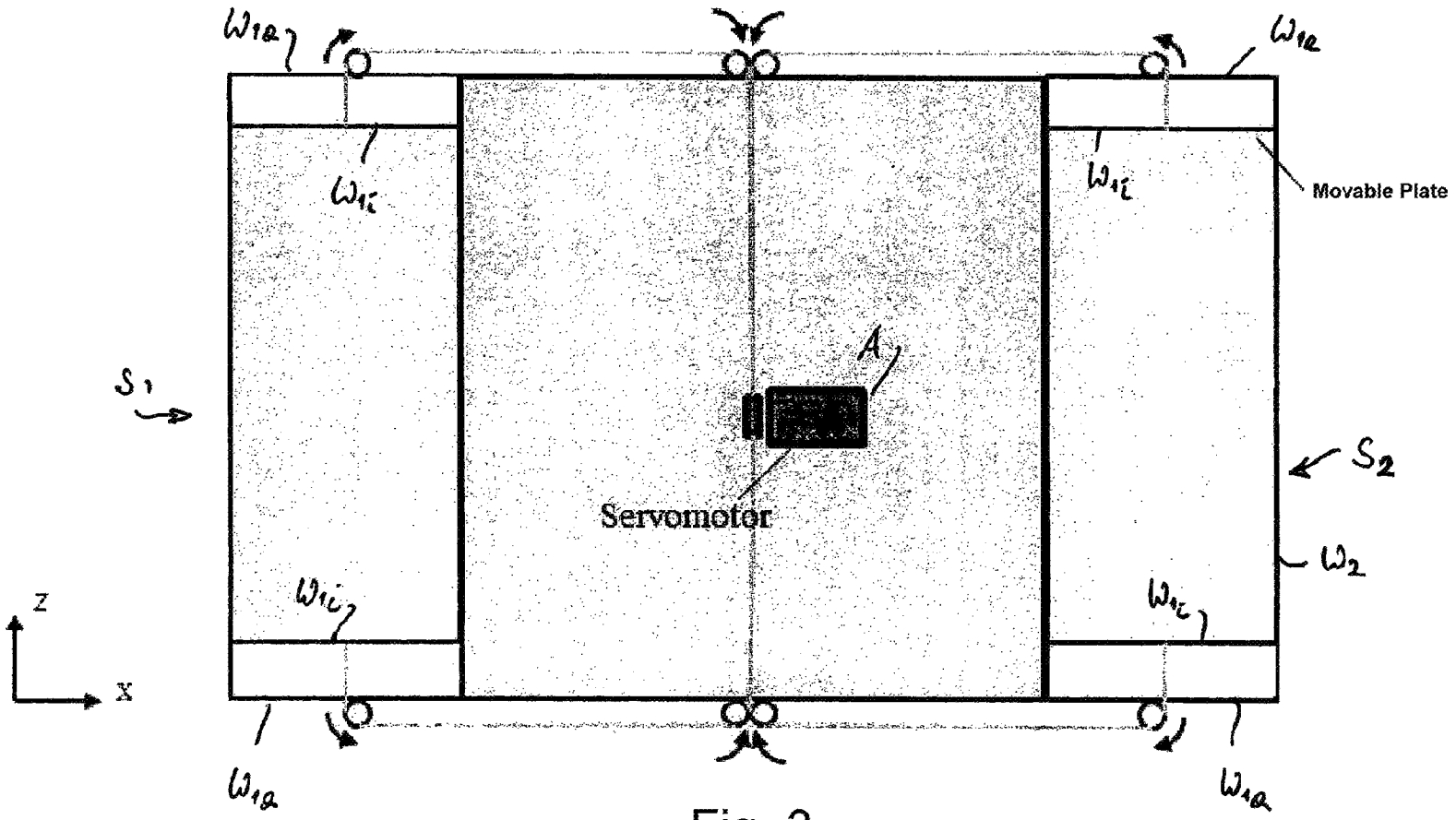

FIG. 3 shows an embodiment in which all the inner walls $W_{1i}$ of the two columns involved are driven simultaneously and through the same stroke by a common actuator A, here a servomotor. The use of a rope or cable guide may be provided here for example, by which, by driving the common actuator A, the effective rope or cable length between the actuator A and all movable inner walls $W_{1i}$ is influenced such the spacing of all of the inner walls $W_{1i}$ to the respective parallel outer walls $W_{1a}$ can be adjusted.

Here the actuator A can be connected with the inner walls $W_{1i}$ via cables passing over idler rollers. For example, according to one embodiment each inner wall $W_{1i}$ is biased inward and the effect thereof is compensated by the counterforce applied via the actuator A, in particular via the cable system.

If the actuator A is thus driven, for example by paying out the cable, this then generates a corresponding decrease in counterforce such that the respective inner walls $W_{1i}$ are displaced further inward and the cross-section of a column is thus reduced, or by winding up the cable a restoring force is generated that exceeds the biasing force, so that the displaceable inner walls $W_{1a}$ are pulled closer to the respective outer walls $W_{1a}$ and the spacing from the outer walls is reduced and the flow cross-section in the respective columns is increased.

Figure 4:
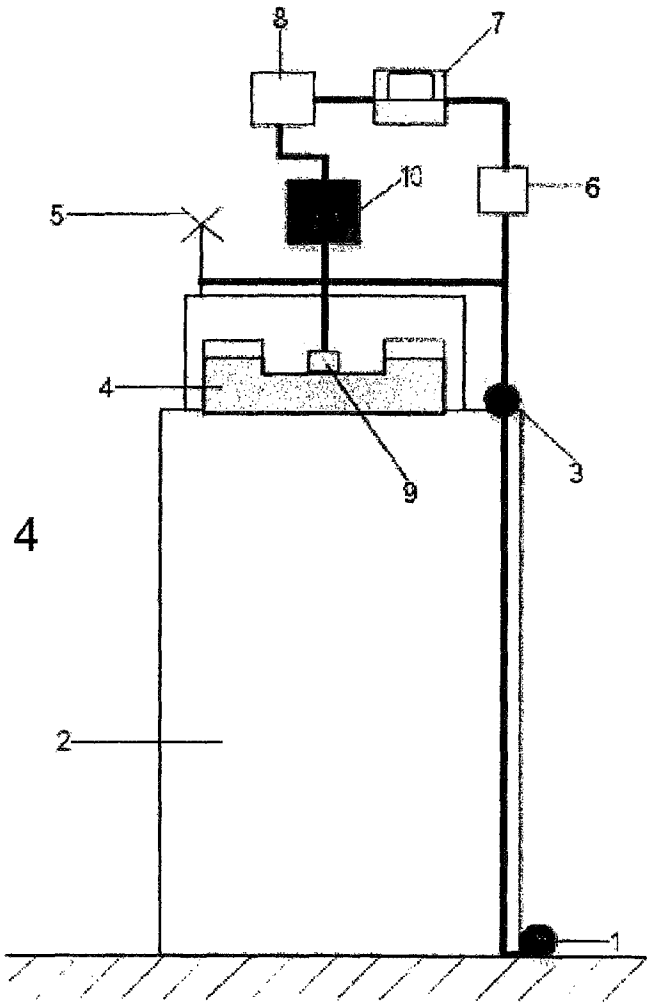

As FIG. 4 shows, at least one liquid-column damping system according to the invention, here shown at 4, is mounted on an object 2 to be vibration damped, represented here in the form of a tower, in particular in an upper region that naturally undergoes a higher deflection under vibration than a lower region.

The system illustrated here provides for the use of at least two vibration sensors 1 and 3, one in the lower region and one in the upper region of the object, in particular at the height of the vibration damping system. In addition, a wind sensor 5 may be used here. Further sensors may also be used as necessary.

After optional amplification by a signal amplifier 6, the sensor values are detected and evaluated by a computer 7, and, depending on this evaluation, prepared as a corresponding signal by a controller 10 or directly by a computer itself, optionally after processing by a signal amplifier 8, in order to actuate an actuator provided according to FIG. 3, for example a servomotor or other actuator for driving the inner wall with this signal that adjusts a desired spacing of the inner wall from the outer wall, in order to achieve a necessary natural damping and/or natural frequency of the vibration damping system.

One may use algorithms for calculation of control signals for the at least one actuator that are known to those skilled in the art as the calculation methods of Hartog, Warburton or Lyapunov.

Also according to the invention the measured values of vibration sensors, such as accelerometers and/or wind sensors are logged with respect to time, as well as the set spacings of the inner walls relative to the outer walls and the column cross-sections and natural frequencies and natural damping thus achieved, for example in a database provided for this purpose, in order to document a proper functioning of a system comprising such a liquid-column damping system, continually and in particular after the occurrence of hazardous situations and/or for insurance claims.

The invention claimed is:

1. A liquid-column damping system for damping building vibrations, the system comprising a substantially U-shaped tank having at least two upright columns spaced horizontally from each other and a base region forming a fluid flow connection between the columns, at least one of the columns having a vertical wall defining a horizontal cross section of the one column;

a body of liquid filling the base region and at least partially filling the columns; and means for adjusting the damping of the liquid-column damping system and/or the natural frequency of the liquid-column damping system by horizontally moving the wall above the base region to change the cross-section of the respective column.

2. A liquid-column damping system for damping building vibrations, the system comprising a substantially U-shaped tank having at least two upright columns spaced horizontally from each other and a base region forming a fluid flow connection between the columns, at least one of the columns having a vertical wall defining a horizontal cross section of the one column and formed above the base region by a movable inner wall panel and a fixed outer wall panel, the inner wall panel being displaceable inward while at least partially parallel to the outer fixed wall panel;

a body of liquid filling the base region and at least partially filling the columns; and means for adjusting the damping of the liquid-column damping system and/or the natural frequency of the liquid-column damping system by horizontally moving the movable inner wall panel to change a horizontal cross-section of the respective column.

3. The liquid-column damping system according to claim 2, wherein the movable inner wall panel is connected at its lower end with the respective outer wall panel.

4. The liquid-column damping system according to claim 2, wherein the one column is formed on each of two mutually opposite walls each with one such movable inner wall panel that can be displaced inward relative to a respective one such fixed outer wall panel.

5. The liquid-column damping system according to claim 2, wherein the movable inner wall panel extends parallel to a flow direction through the base region between the columns.

6. The liquid-column damping system according to claim 5, wherein the movable inner wall panel is formed from at least one plate mounted pivotally on the fixed outer wall panel.

7. The liquid-column damping system according to claim 4, wherein a position of each of the inner wall panels relative to the respective outer wall panel is adjustable by at least one drive assembly formed by a single drive with which the positions of all inner wall panels of all columns can be adjusted simultaneously, or respective drives for each column with which mutually opposite inner wall panels of the respective column can be adjusted simultaneously, or respective drives for each inner wall panel with which the position thereof is adjustable.

8. The liquid-column damping system according to claim 2, wherein the movable inner wall panel is guided with its side regions on two opposite, immobile surfaces of the respective column.

9. A liquid-column damping system for damping building vibrations, the system comprising a substantially U-shaped tank having at least two upright columns spaced horizontally from each other and a base region forming a fluid flow connection between the columns, at least one of the columns having a movable vertical column wall defining a horizontal cross section of the one column, the movable wall being formed by a fixed outer wall panel and a movable inner wall panel, the inner wall panel bring formed in turn from upper and lower movable plates that are pivoted to each other at an upper horizontal axis at a lower edge of the upper plate and an upper edge of the lower plate, the lower plate being pivoted at a horizontal lower axis on the fixed outer wall panel and being guided to always extend parallel to the fixed outer wall panel;

a body of liquid filling the base region and at least partially filling the columns; and means for adjusting the damping of the liquid-column damping system and/or the natural frequency of the liquid-column damping system by horizontally moving the wall to change the cross-section of the respective column.

10. A liquid-column damping system for damping building vibrations, the system comprising:

a substantially U-shaped tank having at least two upright columns spaced horizontally from each other and a base region forming a fluid flow connection between the columns, at least one of the columns having a movable vertical column wall defining a horizontal cross section of the one column;

a body of liquid filling the base region and at least partially filling the columns;

means for adjusting the damping of the liquid-column damping system and/or the natural frequency of the liquid-column damping system by horizontally moving the movable wall to change the cross-section of the respective column;

upper and lower vibration sensors at upper and lower regions of a building whose vibrations are to be damped;

a level sensor and/or wind sensor; and a control computer adapted to calculate a necessary natural frequency and/or necessary natural damping from outputs of the sensors and to set the necessary damping by adjustment of at least one movable column wall.

* * * * *